United States Patent [19]

Thenon et al.

[11] 4,015,792

[45] Apr. 5, 1977

[54] DEVICE FOR ALTERNATELY WINDING FLEXIBLE BANDS AND THE LIKE BETWEEN TWO ROLLS

[75] Inventors: Christian Thenon, Chatillon-sur-Cluses; Bernard Pelletier, Cluses, both of France

[73] Assignee: Etablissements Carpano & Pons, France

[22] Filed: Mar. 26, 1976

[21] Appl. No.: 670,713

[30] Foreign Application Priority Data

Apr. 11, 1975 France ..... 75.11404

[52] U.S. Cl. ..... 242/67.4

[51] Int. Cl.[2] ..... B65H 17/02

[58] Field of Search ..... 242/67.4, 201; 197/160

[56] References Cited

UNITED STATES PATENTS

| | | | |
|---|---|---|---|
| 2,646,229 | 7/1953 | Clough | 242/67.4 |
| 2,965,325 | 12/1960 | Hall | 242/67.4 |
| 3,095,157 | 6/1963 | Nichols | 242/67.4 |
| 3,317,157 | 5/1967 | Leiber | 242/67.4 X |

*Primary Examiner*—Edward J. McCarthy

*Attorney, Agent, or Firm*—Robert E. Burns; Emmanuel J. Lobato; Bruce L. Adams

[57] ABSTRACT

A device for alternately winding a flexible sheet between two rolls so that as the sheet winds on one roll it unwinds from the other comprises a single reversible driving motor connected by belts to drive shafts which drive the respective rolls via unidirectional couplings. The respective speeds of the drive shafts are related to the maximum and minimum roll diameters to ensure that the sheet remains taut between the rolls.

7 Claims, 9 Drawing Figures

DEVICE FOR ALTERNATELY WINDING FLEXIBLE BANDS AND THE LIKE BETWEEN TWO ROLLS

BACKGROUND OF THE INVENTION

The invention relates to devices for alternately winding a flexible element between first and second rotary supports to which the element is connected to form first and second rolls one of which winds up while the other unwinds, comprising a single reversible rotatable driving means actuable at will in either direction and kinematically connected simultaneously to first and second turning elements, and first and second coupling means between the first turning element and the first rotary support and the second turning element and the second rotary support respectively for driving said flexible element in either direction while maintaining it taut.

In a device of this type described in French patent specification No. 385,347 it was proposed to provide identical first and second coupling means each formed by a non-reciprocal unidirectional clutch. The turning elements were formed by toothed wheels freely mounted on shafts of the rotary supports, these toothed wheels being extended by hubs which each had a cam-forming slot cooperating with a pin fixed to the corresponding shaft to ensure driving engagement or disengagement of the turning element.

However, this known arrangement does not take into account the maximum and minimum diameters of the rolls. Now, for the flexible element, for example a band of paper, to be kept taut between the two rolls, the driven roll (i.e., that which unwinds) must be pulled by the paper at a speed of rotation which is always greater than the speed at which the driving means tends to drive it by the intermediary of a belt or clutch drive coupling. It can be shown that the relation to be satisfied is $D/d \leqslant W2/W1$ where D is the maximum diameter of the roll corresponding to the first turning element and $d$ the minimum diameter of the roll corresponding to the second turning element, and W1 and W2 are the speeds of rotation of the corresponding turning elements.

SUMMARY OF THE INVENTION

An aim of the invention is to take into account the said relation in the choice of the arrangement of the coupling means between the turning elements and the rotary supports.

The device according to the invention is characterized in that where the speeds of rotation W1 and W2 respectively of said first and second turning elements, the maximum diameter D of said first roll and the minimum diameter $d$ of said second roll are such as to always satisfy the relation $D/d \leqslant W2/W1$, said first coupling means comprises a non-reciprocal unidirectional coupling and said second coupling means comprises a reciprocal unidirectional coupling, or there is a frictional slip coupling intercalated in the kinematic link between said driving means and said first rotary support and said second coupling means comprises an unidirectional coupling.

Either of these combinations enables a permanent tension of the flexible element to be ensured for either direction of drive, by simple means which take into account the maximum and minimum diameters of the rolls.

BRIEF DESCRIPTION OF THE DRAWINGS

The accompanying drawings show, by way of example, several embodiments of the invention. In the drawings:

FIGS. 1 to 7 show a device forming a winding display table useful notably as an advertising panel or as a conference screen which may be written on or bear printed information.

Figure 3:
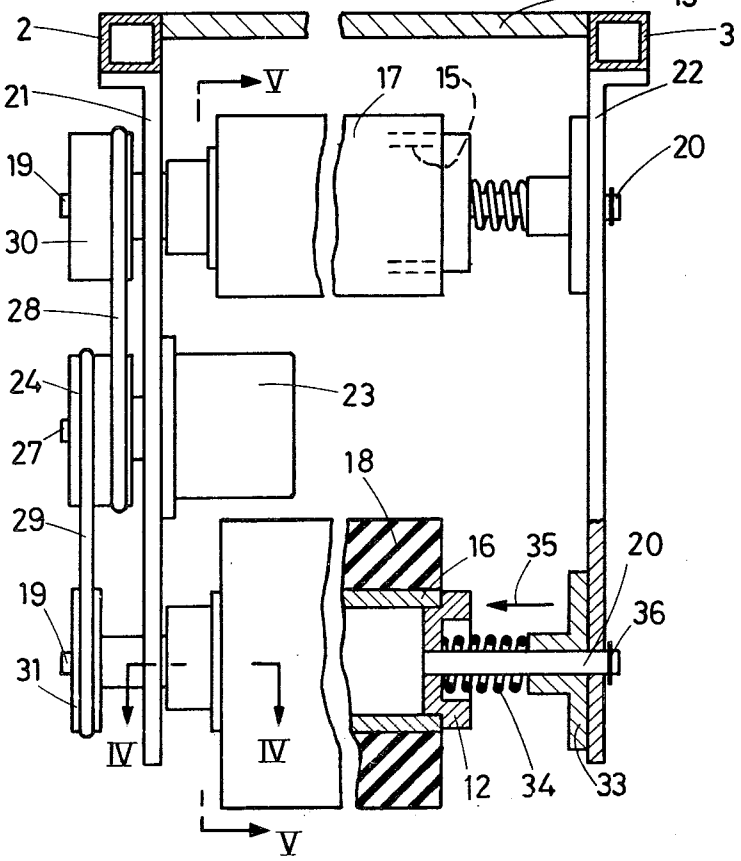
FIG. 3 is a view, partially in cross-section along line III-III of FIG. 2, of part of the first embodiment.

This device includes a frame 1 formed of two square-section parallel tubes 2 and 3 held spaced apart by two cross-bars 4 and 5. The frame 1 may rest on the ground by feet 6, shown partially. Two return rollers 7 and 8 are mounted on pivots 9 lodged in recesses 10 in the ends of tubes 2 and 3. A flexible web or band 11, formed for example of paper, is held taut between the rollers 7 and 8 which define between themselves a zone 12 for the inscription and/or reading of information, behind which is disposed a rigid planar support 13. Beyond the zone 12, the paper band 11 partly surrounds the rollers 7 and 8 and its ends are each fixed to and wound on a respective rotary tubular support or reel 15 and 16, in a manner to form two rolls 17 and 18. As shown on FIG. 3, each rotary support includes, at its opposite ends, pivoting shafts 19 and 20 respectively. Two plates 21 and 22, respectively fixed on tubes 2 and 3, hold these shafts and thereon the two rotary supports 15 and 16 in place. A reversible reducing motor 23 is fixed on the plate; its driving shaft 27 carries a drive pulley 24 kinematically connected by belts 28 and 29 to pulleys 30 and 31 fixed on respective shafts 19 of supports 15 and 16.

The two rotary supports 15 and 16 are identical. As shown on FIG. 3, each of them has at one of its ends a first centring element 32 dimensioned to penetrate inside the support 15 or 16. The centring element 32 is fixed at one end of the shaft 20 which pivots in a bearing 33 fixedon plate 22. A helicoidal compression spring 34 constantly biases the centring element 32 in direction 35; but the corresponding axial movement of element 32 and shaft 20 is limited by a stop 36 on the shaft 20.

Figure 4:
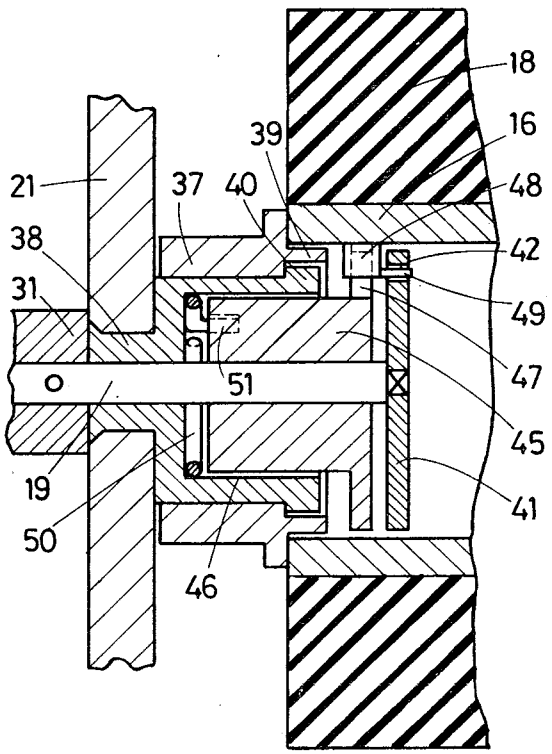
FIG. 4 is a cross-section along line IV-IV of FIG. 3, showing a detail of a non-reciprocal unidirectional coupling.

As shown on FIG. 4, the second end of each rotary support, for example 16, is engaged on a second centring element 37 pivotally mounted on a bearing 38 fixed in plate 21. A relatively great radial play is provided between an outside surface of an annular, coaxial part 39 of the centring element 37 and on inside surface of support 16. The second centring element 37 is axially retained on the fixed bearing 38 by a collar 40 of said bearing 38. The shaft 19 is turnably mounted in the bearing 38. The end of shaft 19 opposite to pulley 31 carries a disc 41 fixed thereon and which has three slots 42 (FIGS. 5 to 7) disposed at 120° to one another, the two sides of each slot forming two parallel cams. The slots 42 are oblique, those of the support 15 being inclined in the opposite direction to those of support 16. A guide support 45, disposed in a coaxial cylindrical housing 46 of bearing 38, is pivoted on the median part of shaft 19. Facing disc 41, the support 45 has a flange with three guide slots 47 disposed radially to the shaft 19. In each guide slot 47 is lodged a sliding pusher 48 having a pin 49 constantly lodged in a respective one of the slot 42 of disc 41. In the bottom of the cylindrical housing 46 is disposed an elastic ring 50 which constantly tends to open and rubs against the periphery of housing 46; a part 51 of this elastic ring 50 is bent perpendicularly and housed in an orifice in the guide support 45.

Figure 5:
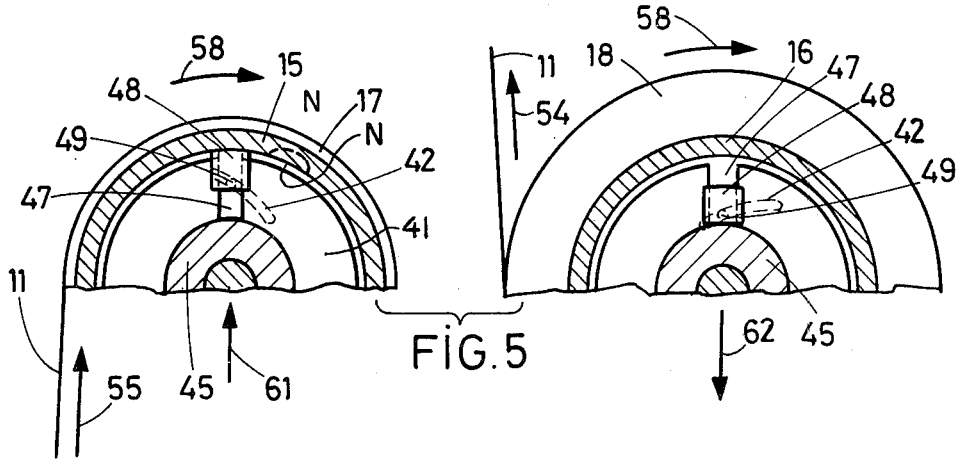
FIGS. 5, 6 and 7 are partial cross-sections along line V—V of FIG. 3, showing two non-reciprocal unidirectional couplings during different phases of operation, but omitting the motor.
Figure 6:
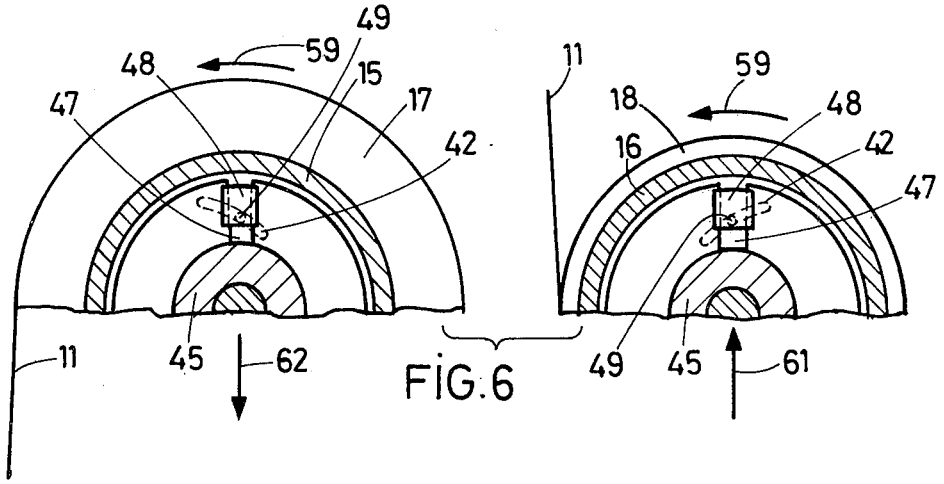
Figure 7:
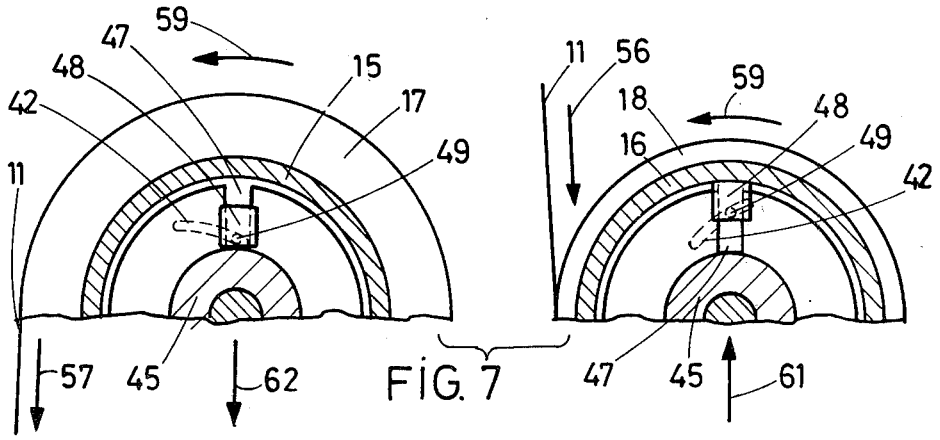

The rotary support, 16 for example, carrying a roll 18 of paper, is placed in the device by firstly moving the centring element 32 in the direction opposite 35 (FIG. 3), then introducing one of the ends of the support 16 onto the second centring element 37, and finally releasing the centring element 32 to a biased in direction 35 and engage in the other end of support 16. The free end of the paper of roll 18 is then passed about rollers 7 and 8 and connected to the rotary support 15. The device is ready to operate. FIGS. 5 to 7 illustrate different phases of operation.

Figure 2:
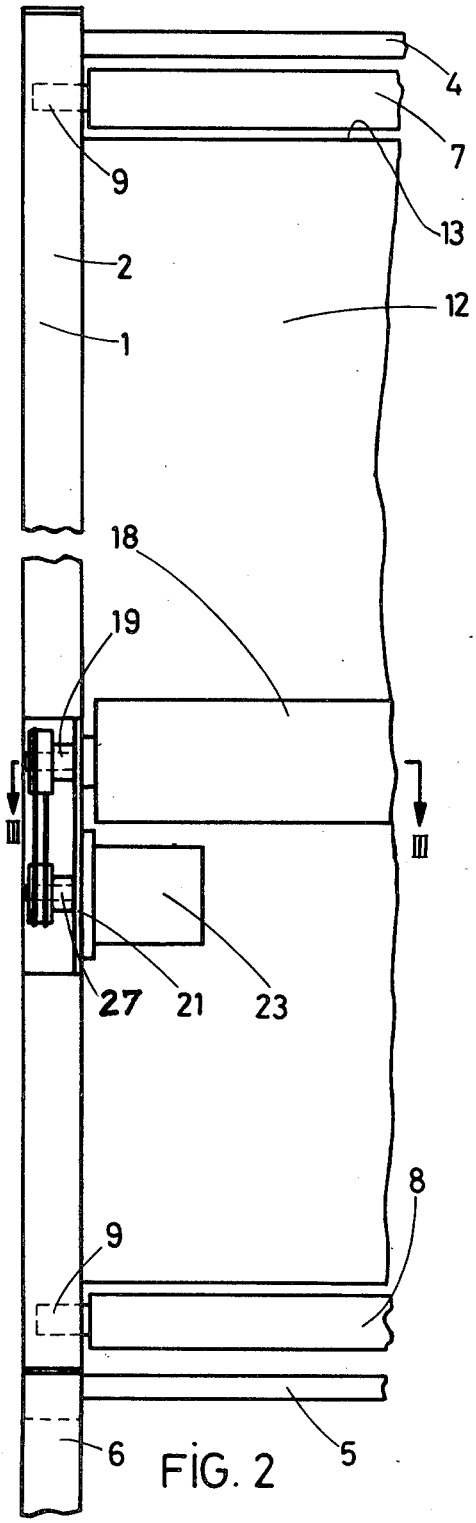
FIG. 2 is a partial rear elevational view, looking from the right of FIG. 1, of the same embodiment, but with the flexible band removed.
Figure 1:
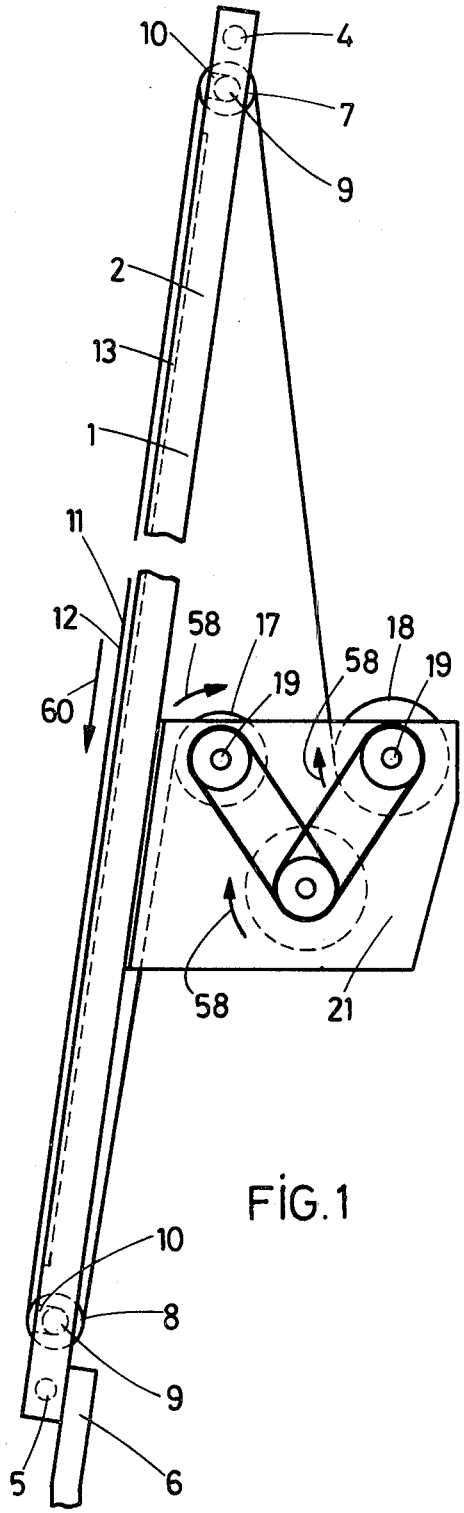
FIG. 1 is a partial side elevational view of a first embodiment of device.

To be able to move in direction 60 (FIG. 1) in zone 12, the paper 11 must unroll according to direction 58 from roll 18 and roll up in the same direction on roll 17. In this example, the motor 23 must thus turn in the same direction 58. Starting of the motor 23 produces the simultaneous rotation of pulleys 30 and 31, hence of shafts 19 and discs 41. Inside the rolls 17–18, each guide support 45 tends to remain stationary under the action of the ring 50 which rubs inside the housing 46 of bearing 38.

As shown on FIG. 5, disc 41 in the roll 17 is rotatably driven in direction 58 and its slots 42 are orientated so that, by the intermediary of a pin 49, they each drive a pusher 48 in direction 61. The pushers 48 thus come to apply against the inner surface of the rotary tubular support 15 which hence is no longer centred and supported only by the centering element 37, but also by the three pushers 48. The rotary support 15 is thus rotatably driven in direction 58 by adherence, and the paper 11 is pulled in direction 55. At the same time, the disc 41 in the winding 18 is rotatably driven in direction 58 and its slots 42 are so oriented that, by the intermediary of a pin 49, they each drive a pusher 48 in direction 62. These pushers 48 are thus held spaced inwardly from the inner surface of the rotary support 16 which rests on its centering element 37 and is free to turn in direction 58 under the traction exerted in direction 54 by the paper winding up on roll 17. This free rotation of the rotary support 16 in relation to the turning element formed by its shaft 19 and disc 41 is possible whatever be the relative speed of these elements.

At any moment, it is possible to rewind the paper onto roll 18. For this, it suffices to reverse the motor 23 to turn in the direction 59. As soon as the discs 41 turn in direction 59, the various elements pass by a position shown in FIG. 6. In this position, the pushers 48 of the rotary support 15 are spaced apart from the inner surface of the support 15, and the pushers 48 of the rotary support 16 have begun to move towards the inner surface of rotary support 16. The device thus passes through an intermediary "disengaged" phase in which the rolls 17 and 18 remain stationary and in which the rotary support 15 is disconnected from its shaft 19 before the rotary support 16 becomes connected to its shaft 19.

FIG. 7 represents the next phase of operation in which the pushers 48 of roll 18 have come to apply against the inner surface of the corresponding rotary support 16, whereas those of the roll 17 remain away from the inner surface of rotary support 15. The roll 18 is thus driven in direction 59, pulling the paper 11 in direction 56. The thus-exerted traction unwinds the paper 11 from the roll 17 according to 57, the roll 17 turning freely, out of driving engagement with the turning element formed by its shaft 19 and disc 41.

Each of the assemblies comprising notably elements 41-45-48 and 51 forms a "unidirectional" coupling since if a disc 41 turns in a given direction of rotation, the corresponding rotary support is driven in rotation in the same direction, but if the same disc 41 turns in the opposite direction, the corresponding rotary support is not driven in rotation. Moreover, these unidirectional couplings are "non reciprocal" since if, instead of actuating the discs 41 in rotation, the rolls and their respective rotary supports are rotated, the discs 41 are not driven in rotation. On this subject, it should be noted that the just-described coupling mechanisms are "non reciprocal" because the discs 41 are constantly kinematically connected (by the belts 28 and 29 in our example), which permits the operation previously described in connection with FIG. 6. However, the just-described non reciprocal unidirectional couplings could be replaced by other equivalent mechanisms producing the same result; hence the coupling used could for example be "non reciprocal" independently of the fact that there is a permanent kinematic connection between the discs 41.

The discs 41 and their slots 42 could be formed otherwise to provide cams other than in the form of slots whose sides form two substantially parallel cams able to act in opposite directions to one another. There could be cams with ramps turned in a single direction, which ramps produce outward displacement of the respective pushers 48 towards the rotary support 15 or 16 against the action of biasing means, formed for example by springs tending to return the pushers 48 in direction 62.

Also, the pushers 48, instead of driving the rotary supports 15 or 16 by adherence could drive them positively. Hence, notches N could be provided in the inner surface of the rotary tubular supports, the pushers 48 coming to lodge therein at the end of their displacement in direction 61 (FIG. 5). Likewise each sliding pusher 48 could include an extension cooperating, not with the inner cylindrical surface of the corresponding rotary support 15 or 16, but with an outer cylindrical part of said rotary supports. A simple inversion of the orientation of the slots 42 of discs 41 would permit such operation.

Moreover, the pulleys 30, 31 which in the described example have substantially identical diameters could have different diameters whereby the two rotary supports 15 and 16 do not turn at the same speed. Likewise, these rotary supports could have different diameters, one, 15 for example, being fixedly mounted on the unwinding device and the other, 16, being formed by a simple card-board tube on which the roll of paper is wound in a paper factory.

Figure 8:
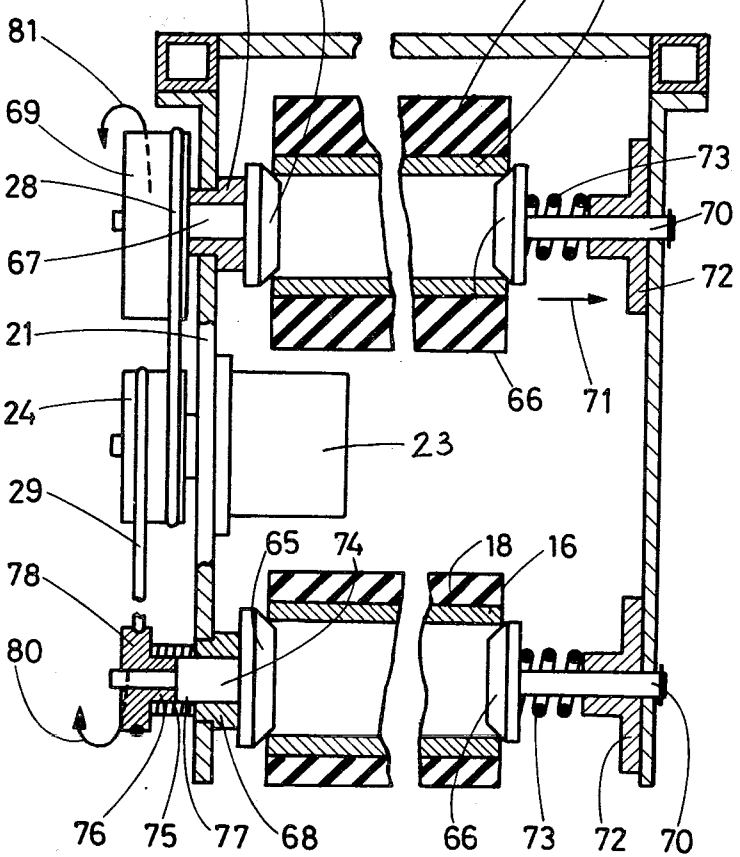
FIG. 8 shows a second embodiment partly in cross-section along line III—III of FIG. 2.

FIG. 8 shows a second embodiment of the invention including a first rotary support 15 for a roll 17. This rotary support 15 is held in position by two conical centring elements 65 and 66. Element 65 is fixed on a shaft 67 pivoted in a bearing 68 fixed in plate 21 it rotates with shaft 67 but is fixed against translational movement. The shaft 67 carries a pulley 69 which is fixed therewith. The centring element 66 is carried by a shaft 70 with which it is integral and with which it can move in direction 71 in a bearing 72 against the action of a helicoidal compression spring 73. Such a displacement enables the roll 17 to be inserted between the two centring elements 65 and 66. The second rotary support 16 of roll 18 is supported in the same manner; the only difference resides in that it carries a pulley 78 of lesser diameter than pulley 69, and this pulley 78 is not constantly fixed for rotation with the shaft, 74, which carries the centring element 65. Instead, pully 78 is pivotally mounted on shaft 74 to which it is connected for rotation by a reciprocal unidirectional coupling formed by a helicoidal spring 75 whose inside fits with a slight grip by one part on a cylindrical boss 76 of pulley 78 and by another part on a corresponding cylindrical end 77 of the shaft 74 which is held for rotation with the rotary support 16. The direction of winding of this spring 75 is such that when the pulley 78 is rotatably driven according to arrow 80 the spring 75 tends to grip about the cylindrical parts 76 and 77 so that the shaft 74 is rotated in the same direction together with roll 18. When the pulley 78 is driven in the direction opposite arrow 80, the spirals of spring 75 ungrip the cylindrical end 77 of shaft 74 which is not rotatably driven. Also, the belt 28 is preferably provided in an elastic material. All of the other elements are identical to those of the previously described first embodiment.

When the motor 23 drives the pulleys 69 and 78 in the direction of arrow 80, the pulley 78 drives the roll 18 in the same direction and is unwound from roll 17. For the paper to always remain taut between the two rolls, it is necessary that the roll 17 be driven by the paper at a speed of rotation which is always greater than that at which the motor 23 tends to drive it by the intermediary of belt 28. It can be demonstrated that this condition is fulfilled if the diameter P1 of pulley 69 and the diameter P2 of pulley 78, as well as the maximum diameter D of roll 17 and the minimum diameter $d$ of roll 18 are such that they satisfy the relation $D/d \leqslant P1/P2$. Hence for example, if the pulleys 69 and 78 have respective diameters of 60 to 30 millimeters, the ratio $D/d$ must be less than or equal to the ratio 60/30. Hence, the diameters D and $d$ may for example be 80 and 50 millimeters respectively.

The difference between the speed of rotation of the roll 17 when it is pulled by the paper and the speed at which the motor 23 tends to drive it by the intermediary of belt 28 is made possible by a slip coupling included in the kinematic chain connecting the rotary support 15 to the shaft of motor 23. In our example, this slip coupling is simply formed by the belt 28 kinematically connected to the driving pulley 24, cooperating with the pulley 69, a slippage being able to occur between the pulley 24 or 69 and belt 28 when the roll 17 is pulled by the flexible bond.

Conversely, when the motor 23 drives the pulleys 69 and 78 in the direction of arrow 81, the roll 17 is also rotatably driven and the paper rolls onto it while unrolling from the roll 18. For the paper to remain taut between the rolls 17 and 18 without being torn, the roll 18 must be driven by the paper at a speed of rotation which is always less than that of pulley 78, so that the reciprocal unidirectional coupling constituted by the spring 75 is never caused to operate. If this did happen, the driven winding 18 would be braked by the pulley 78 with which it would be fixed for rotation and the paper would rip between the two rolls. To avoid this, it suffices that the previously stated relation $D/d \leqslant P1/P2$ be satisfied.

The drive of the mobile elements, here 69 and 78, could be bya gear train instead of by belts. In this case, the slip coupling can no longer be formed by the belt 28 and pulleys 24 or 69 but an equivalent friction mechanism is intercalated in the kinematic chain connecting the rotary support 15 to the shaft of motor 23. In this instance, the diameters P1 and P2 of the pulleys would no longer play a part in the above-mentioned relation; these pulley diameters would be replaced by the respective speeds W1 and W2 of the shafts 67, 74 which speeds are inversely proportional to the diameters P1 and P2. The relation to be satisfied would be $D/d \leqslant W2/W1$.

According to a variation of the second embodiment, not shown on the drawings, the reciprocal unidirectional coupling formed notably by the spring 75 is replaced by a non-reciprocal unidirectional coupling operating in the same direction, for example one of the coupling mechanisms described in the first embodiment. Operation of the assembly is identical to that of the second embodiment.

Figure 9:
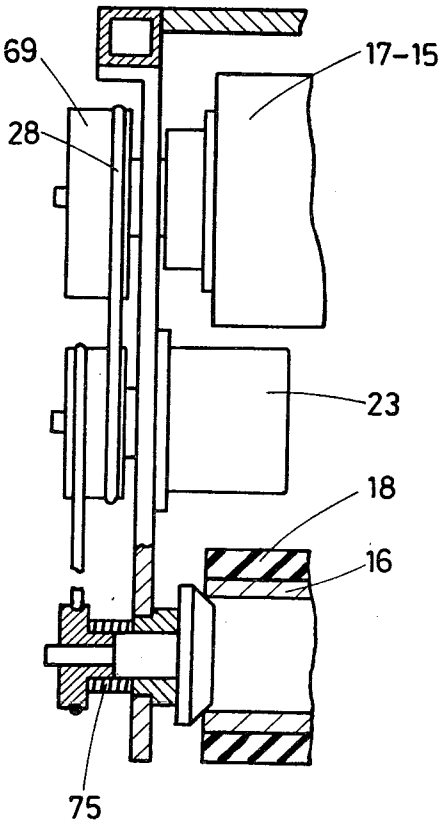
FIG. 9 shows a third embodiment partly in cross-section along line III—III of FIG. 2.

FIG. 9 partially shows a third embodiment in which the friction means 24 or 69 and 28 of the second embodiment are replaced by a non-reciprocal unidirectional coupling mechanism formed for example by one of the mechanisms described in the first embodiment. The belt 28 and pulley 69 still retain their driving function when the roll 17 is driving; when this winding is driven (i.e., pulled by the paper), it is the non-reciprocal unidirectional mechanism that plays the same role as the slip coupling of the second embodiment. Operation of the assembly is the same as for the second embodiment.

The single drive means of the described embodiments could be formed not by a reversible reducing motor, but for example by a simple crank manually actuable in both directions.

The device according to the invention may be employed whenever it is desired that a flexible web, band or similar element of great length, each end of which is wound on a rotary support, should be easily unwound from one rotary support and simultaneously wound up on another, while constantly holding the flexible element under tension.

Particularly interesting applications are advertising screens, timetables, and conference screens for displaying information and/or writing.

What is claimed is:

1. Apparatus for reversibly winding a flexible band into a roll, comprising;

first and second reels connectable respectively to opposite ends of a flexible band for reversibly winding the band onto a winding-up one of the reels to permit providing a roll of the band wound up on the one reel up to a maximum roll diameter D and for thereby unwinding the band from an unwinding one of the reels down to a minimum roll diameter *d;* and means for turning the reels, comprising a single drive means reversibly rotatable for the reversible winding, first and second turning elements turnable by the drive means for turning the first and second reels respectively at respective rotary speeds W1 and W2 which satisfy a relation $D/d \leqslant W2/W1$ to keep the band taught while the roll diameters change between D and *d*, and first and second unidirectional coupling means disposed respectively between the first turning element and the first reel and between the second turning element and the second reel, for alternately enabling the first and second turning elements to turn the respective reels for alternate winding up and unwinding of the roll on either reel.

2. Apparatus according to claim 1, wherein each unidirectional coupling means is nonreciprocal, having cam means rotatably secured to the respective turning element for radial displacement of cam follower means, a guide support rotatable with one of the reels relative to said cam means, said guide support facing said cam means and defining a substantially radial guide slot, and a coupling pusher slidable in the guide slot and having secured thereto the cam follower displaceable by the cam means for enabling the pusher to engage a cylindrical surface of the guide support in response to rotation of the respective cam means in one direction to couple the guide support to the turning element, subject to disengagement of the pusher from said cylindrical surface when the respective cam means turns in a direction opposite to said given direction whereby the pusher non-reciprocally couples the turning element to the guide support on predetermined turning of the turning element and cam means and avoids reciprocal coupling of the turning element to the guide support when the guide support is turned by the respective reel.

3. Apparatus according to claim 2, in which the cylindrical surface of the guide support has notches and the pusher is engageable with the notches.

4. Apparatus according to claim 2, including elastic means biasing the pusher to disengage it from the cylindrical surface, and friction means for frictionally opposing rotation of the guide support.

5. Apparatus according to claim 2 in which the unidirectional non-reciprocal coupling means are substantially identical with one another.

6. A device according to claim 1 in which one of the first and second unidirectional coupling means is non-reciprocal and the other is reciprocal, being actuatable by turning of the respective turning element and also by turning of the respective reel.

7. Apparatus for reversibly winding a flexible band into a roll, comprising;

first and second reels connectable respectively to opposite ends of a flexible band for reversibly winding the band onto a winding-up one of the reels to permit providing a roll of the band wound up on the one reel up to a maximum roll diameter D and for thereby unwinding the band from an unwinding one of the reels down to a minimum roll diameter *d;* and means for turning the reels, comprising a single drive means reversibly rotatable for the reversible winding, first and second turning elements turnable by the drive means for turning the first and second reels respectively at respective rotary speeds W1 and W2 which satisfy a relation $D/d \leqslant W2/W1$ to keep the band taught while the roll diameters change between D and *d*, and coupling means for alternately enabling the first and second turning elements to turn the respective reels, comprising a slip coupling device between the first turning element and the first reel, and a unidirectional coupling device between the second turning element and the second reel.

* * * * *